US006665504B2

(12) United States Patent
Lee et al.

(10) Patent No.: US 6,665,504 B2
(45) Date of Patent: Dec. 16, 2003

(54) FUSING DEVICE OF ELECTROPHOTOGRAPHIC IMAGE FORMING APPARATUS

(75) Inventors: Kyung-woo Lee, Gyeonggi-do (KR); Tae-ken Oh, Gyeonggi-do (KR)

(73) Assignee: Samsung Electronic Co., Ltd., Suwon (KR)

( * ) Notice: Subject to any disclaimer, the term of this patent is extended or adjusted under 35 U.S.C. 154(b) by 0 days.

(21) Appl. No.: 10/252,693

(22) Filed: Sep. 24, 2002

(65) Prior Publication Data

US 2003/0091374 A1 May 15, 2003

(30) Foreign Application Priority Data

Sep. 27, 2001 (KR) ..... 2001-60143

(51) Int. Cl.[7] ..... G03G 15/20

(52) U.S. Cl. ..... 399/90; 219/216; 219/469; 399/330; 492/47

(58) Field of Search ..... 399/330, 90; 219/216, 219/469; 432/60; 492/47

(56) References Cited

U.S. PATENT DOCUMENTS

| | | | | | |
|---|---|---|---|---|---|
| 4,172,976 | A | * | 10/1979 | Namiki et al. | 219/469 |
| 4,820,904 | A | * | 4/1989 | Urban | 219/216 |
| 4,952,782 | A | * | 8/1990 | Yokokawa et al. | 219/469 |
| 5,990,458 | A | * | 11/1999 | Hyllberg et al. | 219/469 |
| 2002/0118984 | A1 | * | 8/2002 | Lee et al. | 399/330 |

FOREIGN PATENT DOCUMENTS

| | | |
|---|---|---|
| JP | 60-55368 | 3/1985 |
| JP | 4-335691 | 11/1992 |
| JP | 4-360185 | 12/1992 |
| JP | 6-348176 | 12/1994 |
| JP | 8-171301 | 7/1996 |
| JP | 8-262905 | 10/1996 |
| JP | 8-305195 | 11/1996 |
| JP | 9-090811 | 4/1997 |
| JP | 11-282294 | 10/1999 |
| JP | 2000-25976 A | 1/2000 |

* cited by examiner

*Primary Examiner*—Joan Pendegrass
(74) *Attorney, Agent, or Firm*—Staas & Halsey, LLP

(57) ABSTRACT

A fusing device of an electrophotographic image forming apparatus includes a tubular internal pipe sealed at its ends to maintain a predetermined internal pressure to accommodate a predetermined amount of a working fluid in its inner space, a heater installed to wrap the internal pipe to generate heat, a power supply unit electrically connected to the heater to supply an external power to the heater, a cylindrical roller installed to wrap the heater, and end caps installed at both ends of the cylindrical roller. Each of the end caps includes a large-diameter portion in which an electrode electrically connected to the power supply unit is to be installed, and a small-diameter portion fittingly fixed to the end of the cylindrical roller by a locking unit. The fusing device has the end caps at both ends of a fusing roller to supply securely electricity from the power supply unit to the heater supplying heat to the fusing roller, thereby providing a maximized durability and operating safety to the fusing roller.

20 Claims, 9 Drawing Sheets

FUSING DEVICE OF ELECTROPHOTOGRAPHIC IMAGE FORMING APPARATUS

CROSS-REFERENCE TO RELATED APPLICATIONS

This application claims the benefit of Korean Patent Application No. 2001-60143, filed Sep. 27, 2002, in the Korean Intellectual Property office, the disclosure of which is incorporated herein by reference.

BACKGROUND OF THE INVENTION

1. Field of the Invention

The present invention relates to a fusing device of an electrophotographic image forming apparatus, and more particularly, to a fusing device of an electrophotographic image forming apparatus having a fusing roller and end caps securing an electric connection between a heater supplying heat to the fusing roller and a power supply device coupled to the heater.

2. Description of the Related Art

FIG. 1 is a schematic perspective view of a conventional electrophotographic image forming apparatus. Referring to FIG. 1, the conventional electrophotographic image forming apparatus includes a paper ejecting unit 1, an operating unit 2, a control board cover 3, an upper cover opening button 4, a paper display window 5, a multi-purpose feeding window 6, a paper cassette 7, an option cassette 8, and an auxiliary stand 9.

FIG. 2 is a schematic cross-sectional view of a fusing device 10 of a conventional electrophotographic image forming apparatus employing a halogen lamp as a heat source.

Referring to FIG. 2, the conventional fusing device 10 includes a cylindrical fusing roller 11 and a heater 12, e.g., the halogen lamp, installed in an interior center portion of the fusing roller 11.

A coating layer 11*a*, such as Teflon, is coated on a surface of the fusing roller 11. The heater 12 generates heat from an interior portion of the fusing roller 11, and the fusing roller 11 is heated by a radiant heat emitted from the heater 12.

FIG. 3 is a longitudinal cross-sectional view illustrating a relationship between the fusing roller and a pressure roller of the conventional electrophotographic image forming apparatus employing the halogen lamp as the heat source as shown in FIG. 2.

Referring to FIG. 3, a pressure roller 13 is disposed to face a sheet of paper 14 at a lower portion of the fusing device 10. The pressure roller 13 is elastically supported by a spring 13*a* to press the paper 14 passing between the fusing roller 11 and the pressure roller 13 with a predetermined pressure. A powdered toner image 14*a* is formed on the paper 14 and is pressed with a predetermined pressure and heated by heat when the paper 14 passes between the fusing roller 11 and the pressure roller 13. In other words, the toner image 14*a* is fused and fixed on the paper 14 by the heat of the fusing roller 11 and pressure of the pressure roller 13.

A thermistor 15 measuring a surface temperature of the fusing roller 11 and a thermostat 16 cutting off a power supply of the heater from an external power source when the surface temperature of the fusing roller 11 exceeds a predetermined set value, are provided at one side of the fusing roller 11. The thermistor 15 measures the surface temperature of the fusing roller 11 and transmits an electric signal corresponding to the measured temperature to a controller (not shown) of a printer (not shown). The controller controls a quantity of electricity supplied to the halogen lamp 12 according to the measured temperature to maintain the surface temperature of the fusing roller 11 within a given range. When the surface temperature of the fusing roller 11 exceeds the predetermined set value because the thermistor 15 and the controller fails in controlling the surface temperature of the fusing roller 11, a contact (not shown) of the thermostat 16 becomes open to cut off the power supply of the halogen lamp 12 from the external power source.

The conventional fusing device 10 using the halogen lamp 12 as the heat source unnecessarily consumes a large amount of electric power. Particularly, when power is turned on, the conventional fusing device 10 requires quite a long warming-up time. The warming-up time may range from several tens of seconds to several minutes. In addition, in the conventional fusing device 10, since the fusing roller 11 is heated by radiation emitted from the heat source 12, heat transmission is slow, and compensation for a temperature deviation caused by a decrease in temperature occurring due to a contact with the paper 14 is slow. As a result, it is difficult to maintain the surface temperature of the fusing roller 11 constant. Moreover, since the electric power must be periodically supplied to the heat source 12 in order to maintain the surface temperature of the fusing roller 11 constant in a standby mode in which an operation of the printer is in pause, unnecessary electric power is consumed. A considerable time is required to convert the standby mode into an operation mode for an image output, thereby making it difficult to achieve a fast image output.

FIG. 4 is a cross-sectional view of another conventional fusing device 200 employed in the electrophotographic image forming apparatus.

Referring to FIG. 4, a heating plate 22 is provided at the inner bottom portion of a flexible, cylindrical film tube 21. A pressure roller 23 is disposed to face the heating plate 22, and the paper 14 is disposed therebetween.

The film tube 21 is rotated by a separate rotating device. Locally heating a portion of the heating tube 21 disposed between the heating plate 22 and the pressure roller 23 consumes a low power, but this method is difficult to be applied to fast printing.

In order to solve the above problem, fusing devices adopting a heat pipe capable of instantaneously heating the fusing devices by a high heat conductivity and having a low power consumption characteristic are disclosed in Japanese Patent publication Nos. Hei 6-348176, Hei 11-282294 and 2000-25976.

In the fusing devices adopting the heat pipe, a heat source is arranged at one portion of a fusing roller, the portion deviating from a fusion area. If the heat source is arranged in such a manner, an overall size of the fusing device may increase. Thus, it is necessary to solve another problem of a structural complexity.

Fusing devices having a heat source incorporated into a fusing roller as disclosed in Japanese Patent publication Nos. Showa 60-55368, Hei 4-335691, Hei 4-360185, Hei 8-171301, Hei 8-262905, Hei 8-305195 and Hei 9-90811, do not encounter an increased structural complexity. However, since these fusing devices have a plurality of heat pipes locally disposed in the fusing roller, a manufacturing process becomes very complex. Also, since the heat pipes are locally disposed in the fusing roller, there is a temperature difference between portions among adjacent heat pipes and portions contacting the heat pipes.

According to a method in which a heat-generating resistive coil is inserted into the heat pipe, power supply portions disposed at both ends of the heat-generating resistive coil are electrically and thermally weak.

In particular, since insulating caps at both ends of the fusing roller are complex in view of shape and structure, an insulation of the insulating caps ensuring durability thereof is difficult to achieve. In addition, due to limitations of a heat-generating resistive element used in the fusing device in view of a voltage withstanding characteristic and a voltage application range, special materials should be used, causing a high manufacture cost.

SUMMARY OF THE INVENTION

To solve the above and other problems, it is an object of the present invention to provide a fusing device of an electrophotographic image forming apparatus with improved end caps establishing a stable electrical connection between a power supply and a heater.

Additional objects and advantageous of the invention will be set forth in part in the description which follows and, in part, will be obvious from the description, or may be learned by practice of the invention.

To achieve the object of the present invention, there is provided a fusing device of an electrophotographic image forming apparatus. The fusing device includes a tubular internal pipe sealed at its ends to maintain a predetermined internal pressure to accommodate a predetermined amount of a working fluid in its inner space, a heater installed to wrap the internal pipe to generate heat, a power supply unit electrically connected to the heater to supply an external power to the heater, a cylindrical roller installed to wrap the heater, and end caps installed at both ends of the cylindrical roller, wherein each end cap includes a large-diameter portion in which an electrode electrically connected to the power supply unit is to be installed, and a small-diameter portion fittingly fixed to the end of the cylindrical roller by a locking unit.

BRIEF DESCRIPTION OF THE DRAWINGS

The above and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
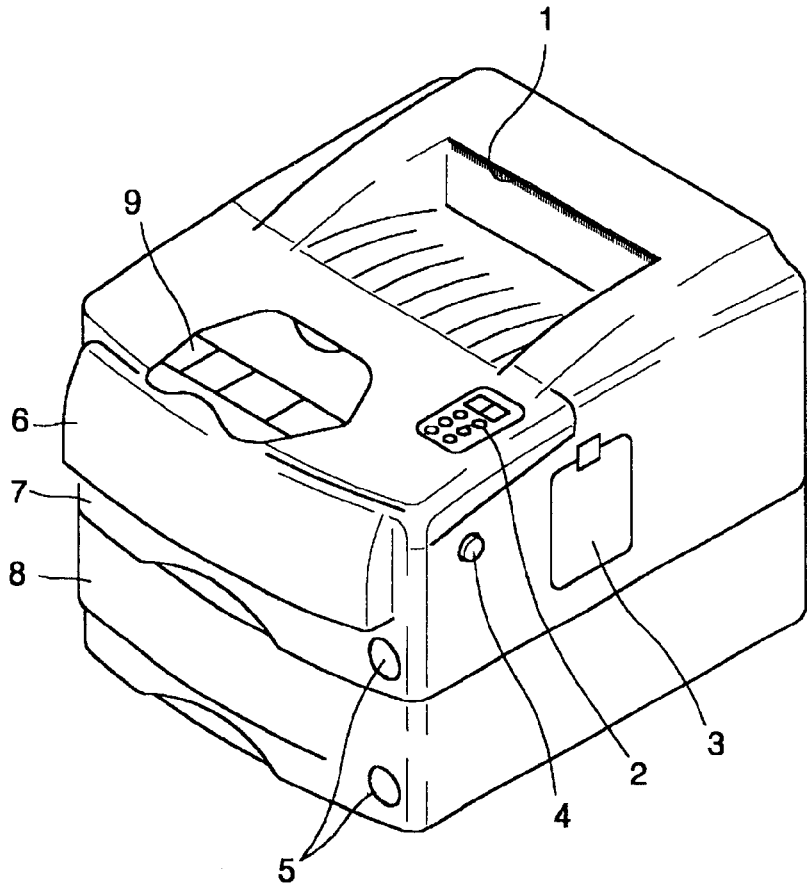
FIG. 1 (PRIOR ART)
FIG. 1 is a perspective view illustrating an outer appearance of a conventional electrophotographic image forming apparatus.
Figure 2:
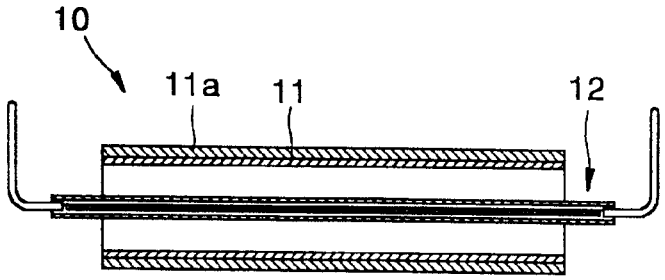
FIG. 2 (PRIOR ART)
FIG. 2 is a cross-sectional view of a fusing device having a halogen lamp as a heat source in the conventional electrophotographic image forming apparatus of FIG. 1.
Figure 3:
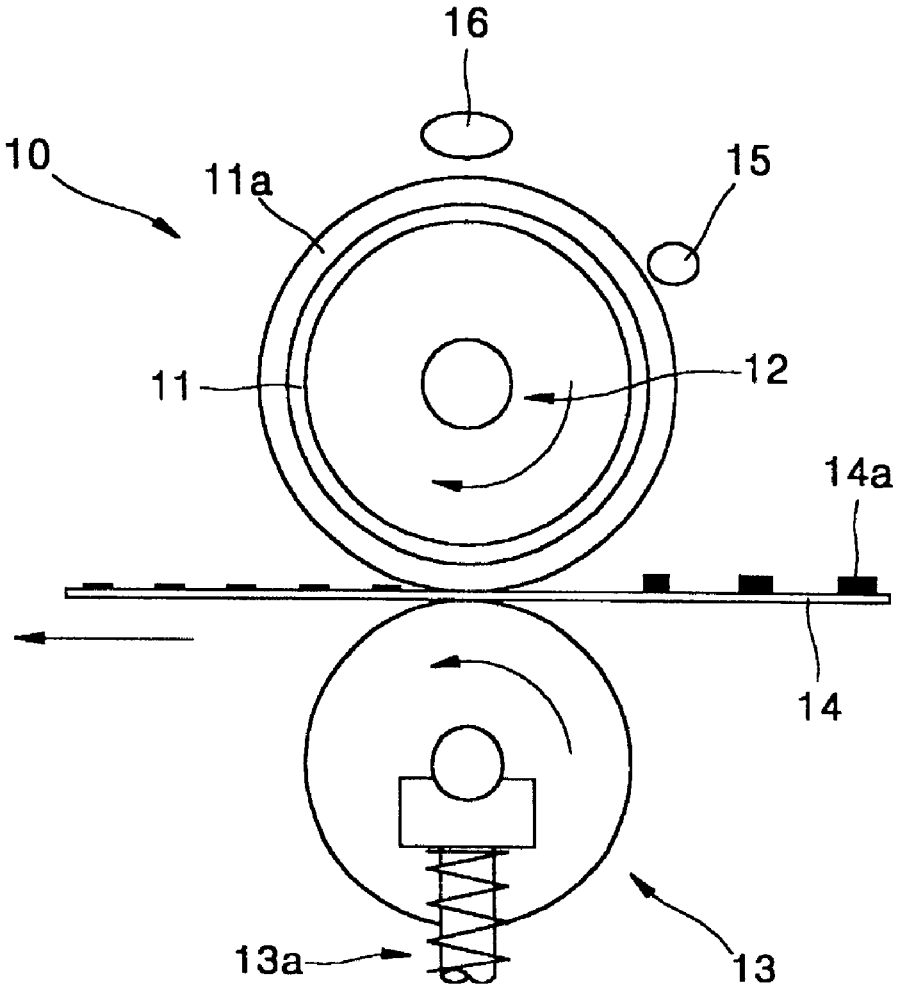
FIG. 3 (PRIOR ART)
FIG. 3 is a cross-sectional view illustrating a relationship between the fusing device and a pressure roller of the conventional electrophotographic image forming apparatus shown in FIG. 2.
Figure 4:
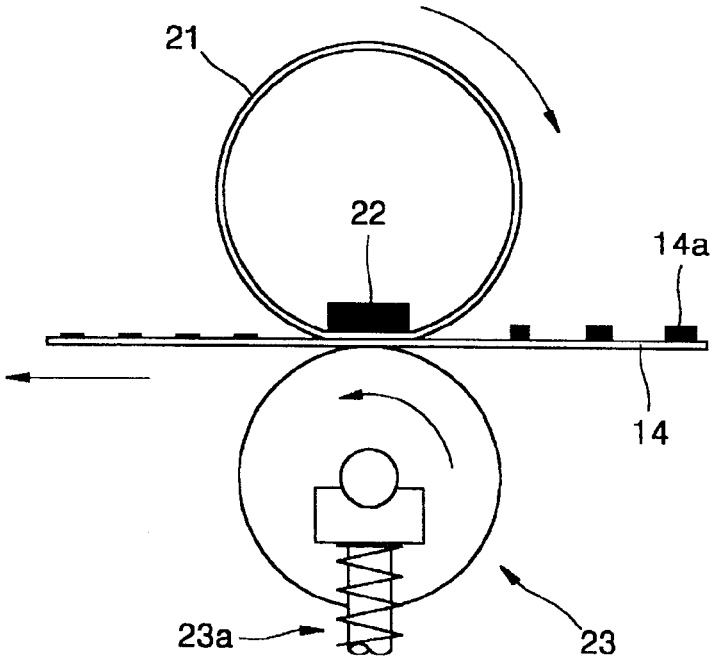
FIG. 4 (PRIOR ART)
FIG. 4 is another cross-sectional view of the conventional fusing device employed in the electrophotographic image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 5:
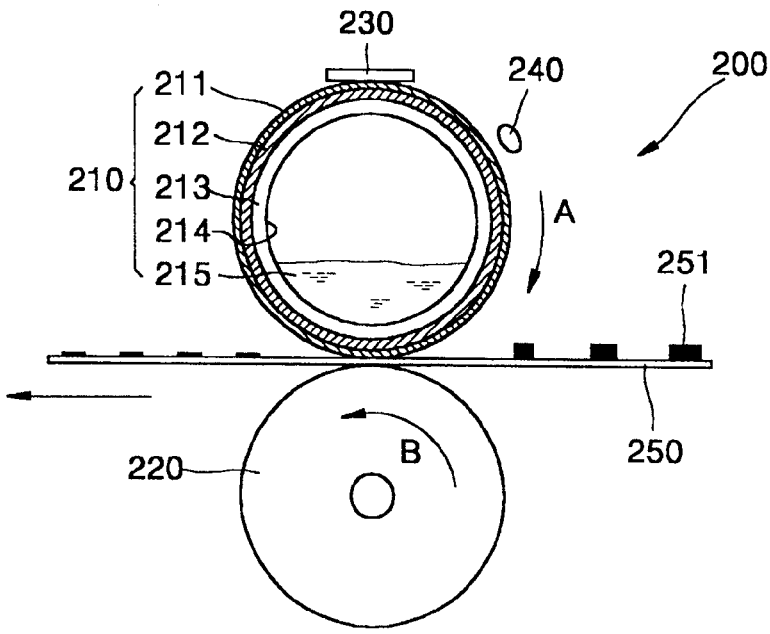
FIG. 5 is a cross-sectional view of a fusing device according to an embodiment of the present invention.
Figure 6:
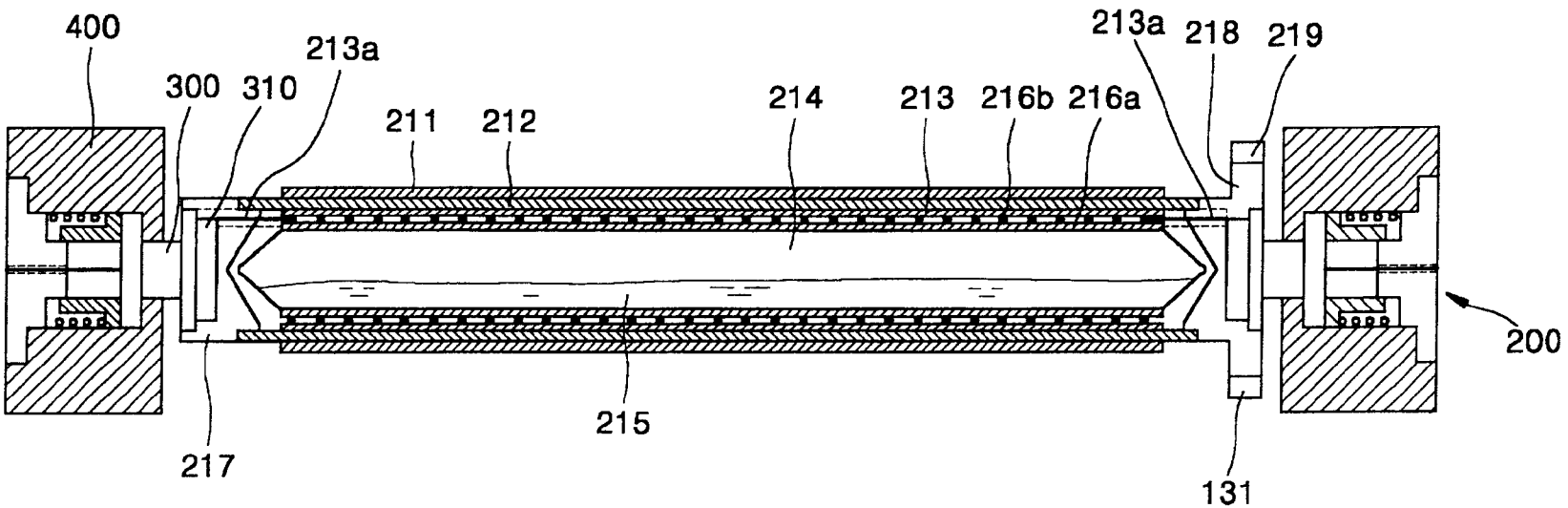
FIG. 6 is a cross-sectional view of a fusing roller of the fusing device shown in FIG. 5.

FIG. 5 is a cross-sectional view of a fusing (fixing) device 200 according to an embodiment of the present invention, and FIG. 6 is a cross-sectional view of a fusing roller 210 of the fusing device 200 shown in FIG. 5.

Referring to FIGS. 5 and 6, a fusing device 200 includes a fusing roller 210 which rotates in a direction in which a sheet of print paper 250 having a toner image 251 thereon is ejected, i.e., in a direction indicated by an arrow A, and a pressure roller 220 which is installed to face the fusing roller 210 through the print paper 250 therebetween and rotates in a direction indicated by an arrow B to be in contact with the fusing roller 210.

The fusing roller 210 includes a cylindrical roller 212, a protective layer 211 coated on the cylindrical roller 212 with Teflon, a heater 213 installed inside the cylindrical roller 212 to generate heat when receiving electricity from a power supply unit 300, and an internal pipe 214 which is installed inside the heater 213 and is sealed at its ends to maintain a predetermined internal pressure.

An insulating layer 216*a* is formed between an outer surface of the internal pipe 214 and the heater 213, and another insulating layer 216*b* is formed between an inner surface of the cylindrical roller 212 and the heater 213. The heater 213 is installed to wrap the inner pipe 214. In this embodiment of the present invention, the heater 213 is a resistive heat-generating coil.

A predetermined fraction of a volume of the inner pipe 214 is filled with a working fluid 215. Also, a power supply unit 300, which is connected to an external power supply supplying the electricity to the heater 213, is installed in a frame 400 disposed adjacent to both ends of the fusing roller 210.

A thermistor 230 is mounted on a top of the fusing roller 210 to be in contact with the protective layer 211 to measure a surface temperature of the fusing roller 210. A thermostat 240 is also installed around the fusing roller 210 to cut off the power (electricity) supply from the power supply unit 300 when the surface temperature of the fusing roller 210 suddenly rises.

An end cap 217 and a power transmission end cap 218 are installed at both ends of the fusing roller 210.

Figure 7A:
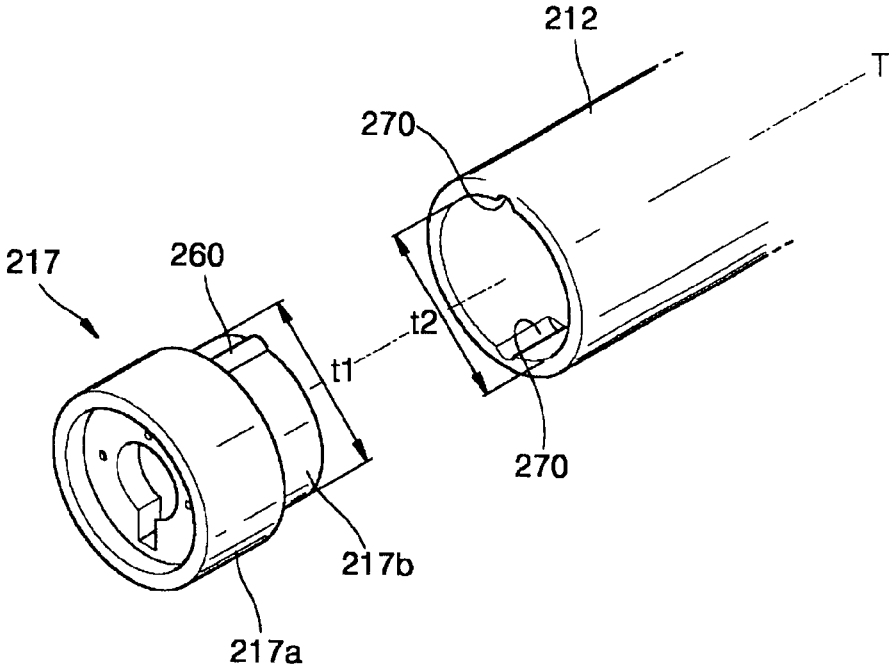
FIG. 7A is an exploded perspective view illustrating an end cap and a cylindrical roller in the fusing device of FIG. 5.
Figure 7B:
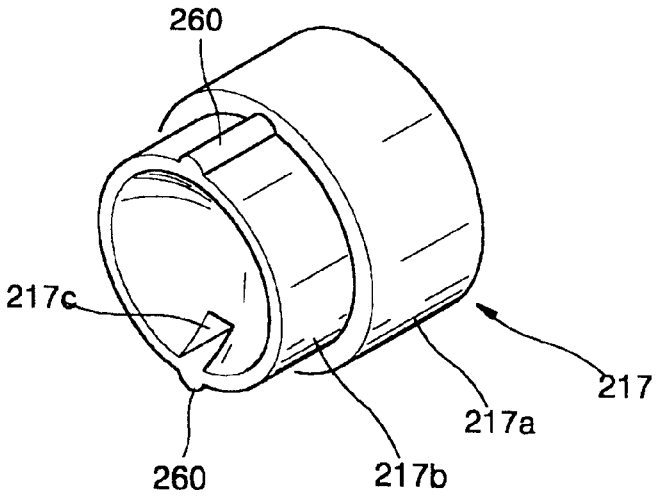
FIG. 7B is a perspective view illustrating the end cap shown in FIG. 7A.
Figure 7C:
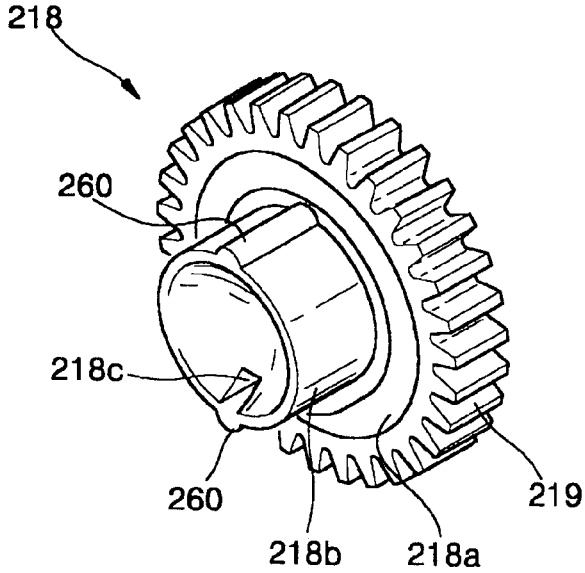
FIG. 7C is a perspective view illustrating a power transmission end cap of the fusing device of FIG. 5.

FIG. 7A is an exploded perspective view illustrating the end cap 217 and the cylindrical roller 212, FIG. 7B is a perspective view illustrating the end cap 217 shown in FIG. 7A, and FIG. 7C is a perspective view illustrating a power transmission end cap of the fusing device 200 of FIG. 5.

Referring to FIGS. 7A and 7B, the end cap 217 includes a large-diameter portion 217*a* and a small-diameter portion 217*b*.

An electrode 310 is electrically connected to the power supply unit 300 to supply the electricity to the heater 213 and inserted into the large-diameter portion 217*a* to contact a lead 213*a* of the heater 213 when the end cap 217 is coupled to the end cap 217 as shown in FIG. 6.

The electrode 310 is connected to the end cap 217 using a fastening unit. In this embodiment, the electrode 310 is connected to the end cap 217 using a mechanical fastening unit such as a bolt or screw.

The small-diameter portion 217*b* is connected to the cylindrical roller 212, and a hole 217*c* is formed at one side of an interior thereof so that the lead 213*a* of the heater 213 is inserted into the hole 217*c* to be connected to the electrode 310. A diameter t1 of the small-diameter portion 217*b* is equal to or slightly greater than an internal diameter t2 of the cylindrical roller 212 to be forcibly fitted into the cylindrical roller 212.

In a state in which the small-diameter portion 217*b* is not properly fitted into the cylindrical roller 212, if the fusing roller 210 is repeatedly rotated for a long time, a fitted portion of the cylindrical roller 212 and the small-diameter portion 217*b* becomes loose. Then, the end cap 217 moves relative to the fusing roller 210 so that the electrode 310 and the lead 213*a* are disconnected from each other. Thus, it is necessary to perfectly fix the small-diameter portion 217*b* onto the fusing roller 210.

To this end, a locking unit is provided on an outer surface of the small-diameter portion 217*b*. The locking unit is configured such that a plurality of convex portions 260 are symmetrically formed on the outer surface of the small-diameter portion 217*b*, and a plurality of concave portions 270 corresponding to the convex portions 260 are formed on an inner surface of the cylindrical roller 212.

Thus, if the small-diameter portion 217*b* is fitted into the cylindrical roller 212, the convex portions 260 are engaged with corresponding ones of the concave portions 270. As the end cap 217 is forcibly fitted into the fusing roller 210, a relative movement between the cylindrical roller 212 and the end cap 217 is suppressed (prevented) by a tight engagement between the convex portions 260 and the concave portions 270, thereby avoiding a disconnection between the electrode 310 and the lead 213*a* of the heater 213.

Referring to FIG. 7C, the power transmission end cap 218 is the same as the end cap 217 in view of configuration. However, a gear 219 is formed on an outer surface of the large-diameter portion 218*a*, and the gear 219 is rotated by a gear of a driving unit (not shown). Thus, the fusing roller 210 is rotated together with the electrode 310.

Figure 8A:
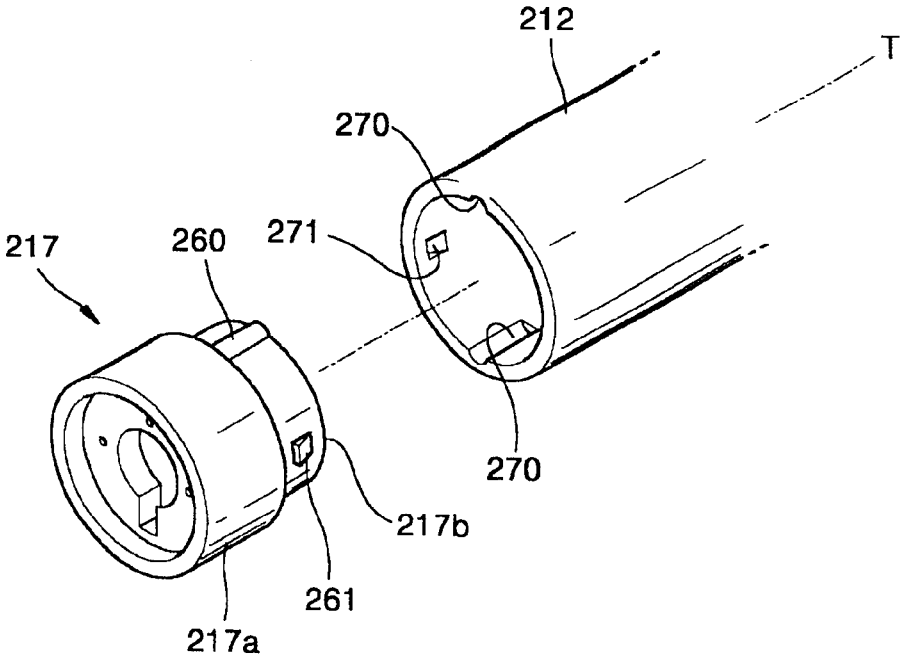
FIG. 8A is an exploded perspective view illustrating an end cap and a cylindrical roller according to another embodiment of the present invention.
Figure 8B:
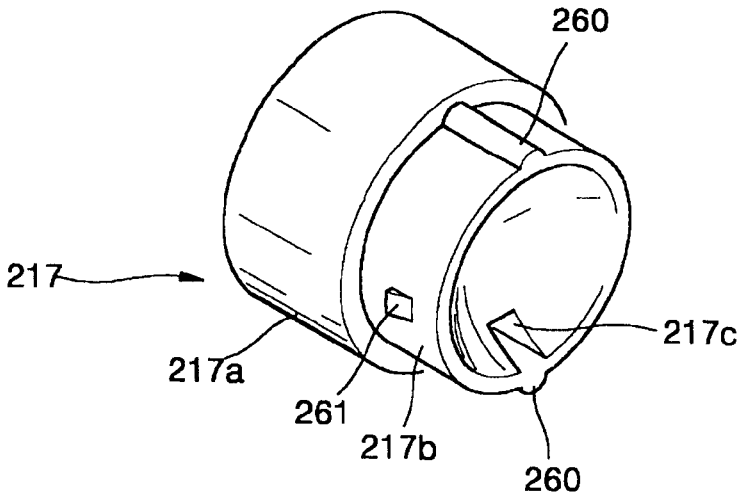
FIG. 8B is a perspective view illustrating the end cap shown in FIG. 8A.

FIG. 8A is an exploded perspective view illustrating the end cap 217 and the cylindrical roller 212 according to another embodiment of the present invention, and FIG. 8B is a perspective view illustrating the end cap 217 shown in FIG. 8A.

Referring to FIGS. 8A and 8B, the end cap 217 is the same as that shown in FIGS. 7A through 7C, except that a plurality of protrusions 261 are further provided on the outer surface of the small-diameter portion 217*b*, and a plurality of recesses 271 are further provided on the inner surface of the cylindrical roller 212.

Since the protrusions 261 are tapered, if the small-diameter portion 217*b* is fitted into the cylindrical roller 212, the protrusions 261 are engaged with the recesses 271, thereby fixing the end cap 217 to the cylindrical roller 212 without the relative movement.

Figure 9:
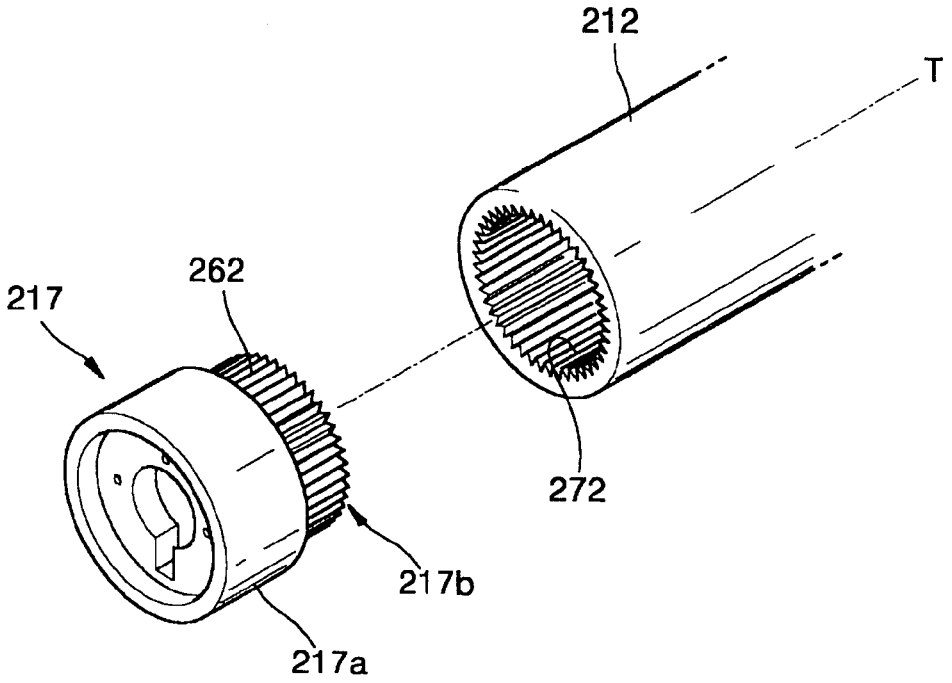
FIG. 9 is an exploded perspective view illustrating the end cap and the cylindrical roller according to another embodiment of the present invention.

FIG. 9 is an exploded perspective view illustrating the end cap 217 and the cylindrical roller 212 according to another embodiment of the present invention.

Referring to FIG. 9, as the locking unit, a male screw portion 262 parallel to an axis T of the cylindrical roller 212 is formed on the outer surface of the small-diameter portion 217*b*, and a female screw portion 272 corresponding to the male screw portion 262 and parallel to the axis T of the cylindrical roller 212 is formed on the inner surface of the cylindrical roller 212.

Figure 10:
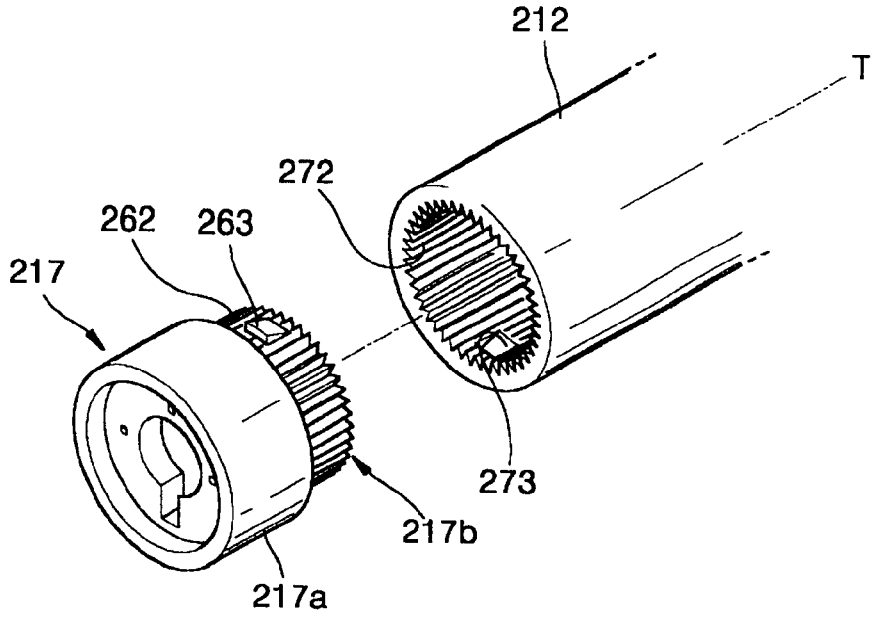
FIG. 10 is an exploded perspective view illustrating the end cap and the cylindrical roller according to another embodiment of the present invention.

FIG. 10 is an exploded perspective view illustrating the end cap and a cylindrical roller according to another embodiment of the present invention.

Referring to FIG. 10, the end cap 217 is the same as that shown in FIG. 9 in view of configuration, except that as the locking unit, a plurality of protrusions 263 are further provided on the outer surface of the small-diameter portion 217*b*, and a plurality of recesses 273 corresponding to the protrusions 263 are further provided on the inner surface of the cylindrical roller 212.

Figure 11:
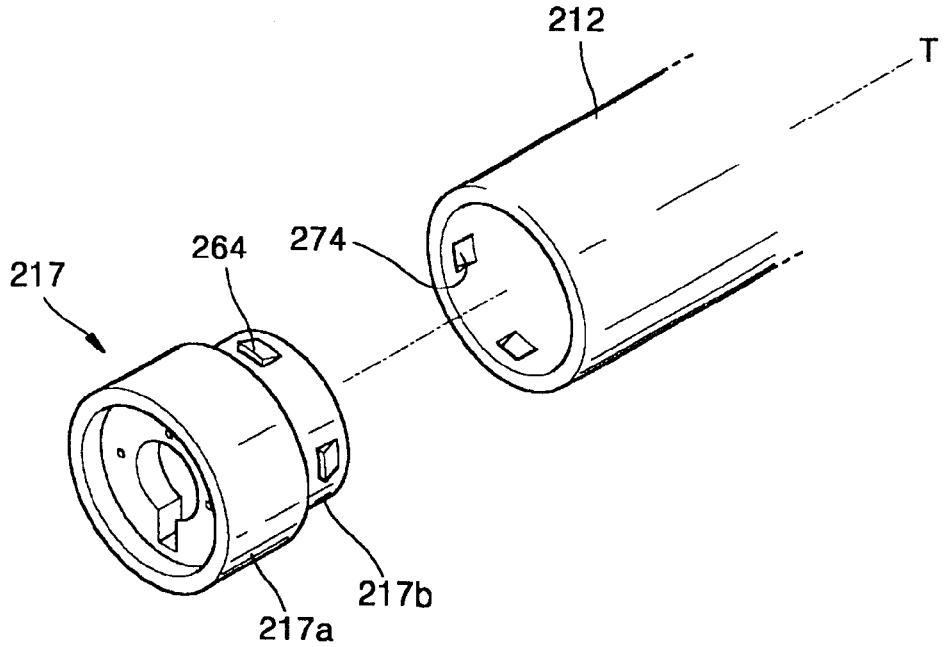
FIG. 11 is an exploded perspective view illustrating the end cap and the cylindrical roller according to another embodiment of the present invention.

FIG. 11 is an exploded perspective view illustrating the end cap 217 and the cylindrical roller 212 according to another embodiment of the present invention.

Referring to FIG. 11, as the locking unit, a plurality of tapered protrusions 264 are formed on the outer surface of the small-diameter portion 217*b*, and a plurality of recesses 274 corresponding to the protrusions 264 are formed on the inner surface of the cylindrical roller 212.

Since the protrusions 264 are tapered, when the end cap 217 is connected to the cylindrical roller 212, the small-diameter portion 217*b* is smoothly inserted into the cylindrical roller 212, and when a perfect insertion is established, the protrusions 264 are engaged with the recesses 274, thereby securely fixing the end cap 217 to the cylindrical roller 212 and simultaneously providing a torque to the cylindrical roller 212 during a rotation of the fusing roller 210.

Figure 12:
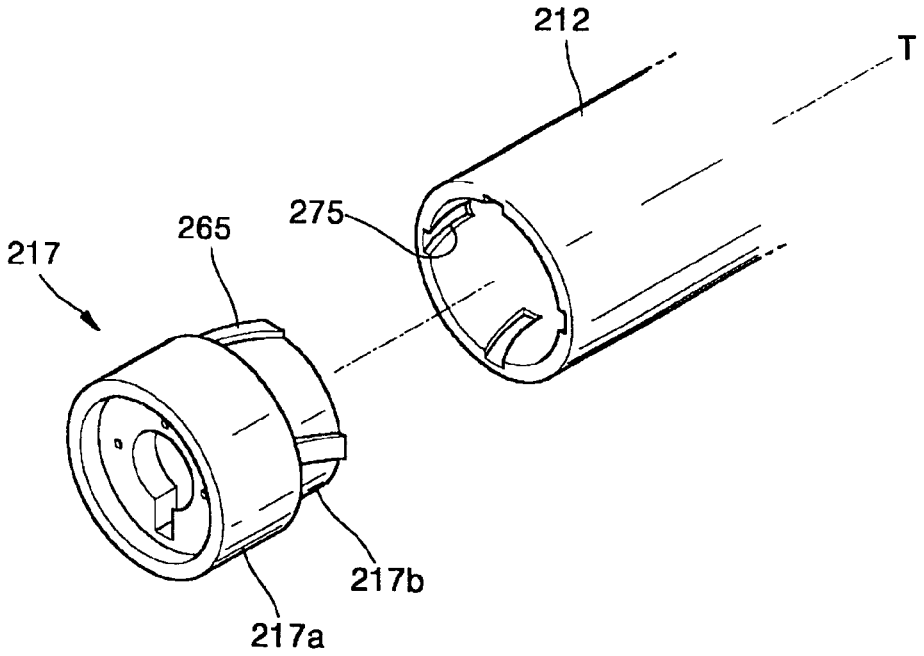
FIG. 12 is an exploded perspective view illustrating the end cap and the cylindrical roller according to another embodiment of the present invention.

FIG. 12 is an exploded perspective view illustrating the end cap 217 and the cylindrical roller 212 according to another embodiment of the present invention.

Referring to FIG. 12, as the locking unit, a plurality of convex portions 265 are formed on the outer surface of the small-diameter portion 217*b* so as to slant at a predetermined angle with respect to the axis T of the cylindrical roller 212, and a plurality of concave portions 275 corresponding to the convex portions 265 are formed on the inner surface of the cylindrical roller 212.

The convex portions 265 may be formed so as to be slanted rightward or leftward with respect to the axis T of the cylindrical roller 212. The above-described configuration provides a connection force for connecting the end cap 217 to the cylindrical roller 212 and provides torque to the cylindrical roller 212 during the rotation of the fusing roller 210. A shape of the convex portions 265 may be a square or a rectangular or may have a predetermined curvature.

Figure 13:
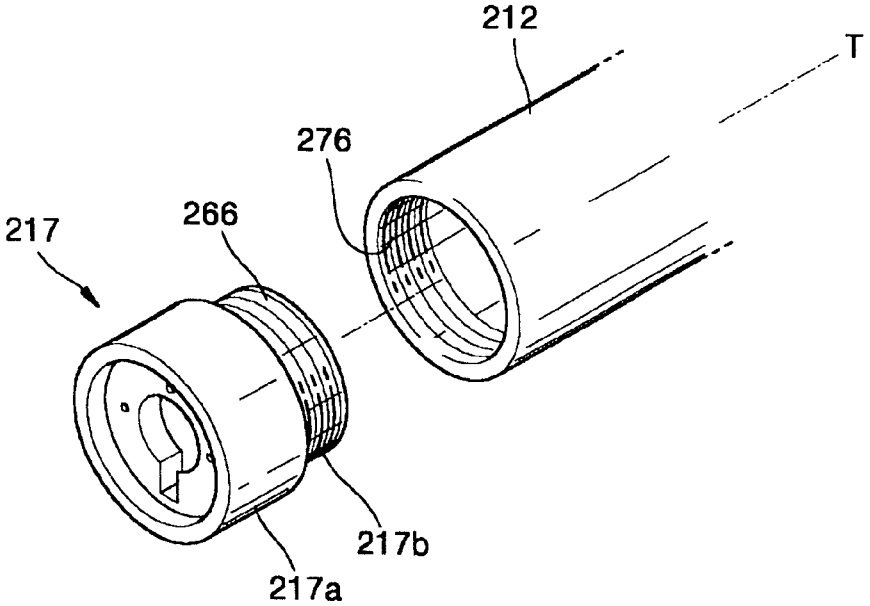
FIG. 13 is an exploded perspective view illustrating the end cap and the cylindrical roller according to another embodiment of the present invention.

FIG. 13 is an exploded perspective view illustrating the end cap 217 and the cylindrical roller 212 according to another embodiment of the present invention.

Referring to FIG. 13, as the locking unit, a male screw 266 is formed on the outer surface of the small-diameter portion 217*b,* and a female screw 276 corresponding to the male screw 266 is formed on the inner surface of the cylindrical roller 212.

Thus, the end cap 217 is connected to the cylindrical roller 212 by rotatably inserting the mal screw 266 into the female screw 276 according to a screw direction. The screw direction can be selected as rightward or leftward in consideration of a rotation direction of the fusing roller 210.

As described above, the fusing device of the electrophotographic image forming apparatus according to the present invention has the end caps at both ends of the fusing roller securely supplying the electricity from the power supply unit to the heater supplying heat to the fusing roller, thereby providing a maximized durability and operating safety to the fusing roller.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A fusing device of an electrophotographic image forming apparatus comprising:

a fusing roller comprising:

a tubular internal pipe sealed to maintain a predetermined internal pressure, and having an inner space to accommodate a predetermined amount of a working fluid, a heater installed to wrap the internal pipe to generate heat, and a cylindrical roller installed to wrap the heater;

a power supply unit having an electrode electrically connected to the heater to supply external power to the heater;

end caps installed at both ends of the cylindrical roller, each having a large-diameter portion in which the electrode of the power supply electrically connected to the power supply unit is installed, and a small-diameter portion fittingly fixed to corresponding end of the cylindrical roller; and a locking unit connecting the small-diameter portion to the corresponding end of the cylindrical roller.

2. The fusing device of claim 1, wherein the locking unit comprises:

a plurality of convex portions formed on an outer surface of the small-diameter portion; and a plurality of concave portions corresponding to the convex portions and formed on an inner surface of the cylindrical roller.

3. The fusing device of claim 2, wherein the locking unit comprises:

a plurality of tapered protrusions formed on the outer surface of the small-diameter portion; and a plurality of recesses corresponding to the protrusions and formed on the inner surface of the cylindrical roller.

4. The fusing device of claim 1, wherein the locking unit comprises:

a male screw portion parallel to an axis of the cylindrical roller formed on an outer surface of the small-diameter portion; and a female screw portion corresponding to the male screw portion, being parallel to an axis of the cylindrical roller, and formed on an inner surface of the cylindrical roller.

5. The fusing device of claim 4, the locking unit comprises:

a plurality of tapered protrusions formed on an outer surface of the small-diameter portion; and a plurality of recesses corresponding to the protrusions and formed on an inner surface of the cylindrical roller.

6. The fusing device of claim 1, wherein the locking unit comprises:

a plurality of tapered protrusions formed on an outer surface of the small-diameter portion; and a plurality of recesses formed on an inner surface of the cylindrical roller to correspond to the protrusions.

7. The fusing device of claim 1, wherein the locking unit comprises:

a plurality of convex portions formed on an outer surface of the small-diameter portion so as to be inclined at a predetermined angle with respect to an axis of the cylindrical roller; and a plurality of concave portions corresponding to the convex portions and formed on an inner surface of the cylindrical roller.

8. The fusing device of claim 1, wherein the locking unit comprises:

a male screw formed on an outer surface of the small-diameter portion; and a female screw corresponding to the male screw and formed on an inner surface of the cylindrical roller.

9. A fusing device of an electrophotographic image forming apparatus comprising:

a fusing roller comprising:

a tubular internal pipe sealed to maintain a predetermined internal pressure and having an inner space to accommodate a predetermined amount of a working fluid, a heater formed around the internal pipe to generate heat and having a lead formed on an end of the heater, and a cylindrical roller formed on the heater;

a power supply unit having an electrode to supply an external power to the heater through the lead; and an end cap having a first portion connected to the electrode of the power supply unit, a second portion fixedly coupled to an end of the cylindrical roller, and a hole formed on the second portion to communicate with the first portion of the end cap and to allow the electrode and the lead of the heater to be connected to each other.

10. The fusing device of claim 9, wherein the lead protrude from the end of the heater of the fusing roller toward the electrode of the power supply unit and is inserted to the hole of the second portion of the end cap to be coupled to the electrode of the power supply unit disposed in the end of the cylindrical roller.

11. The fusing device of claim 9, wherein the hole of the second portion is parallel to a longitudinal axis of the cylindrical roller.

12. The fusing device of claim 9, wherein the first portion and the second portion are formed in a single monolithic body.

13. The fusing device of claim 9, further comprising a frame rotatably supporting the power supply unit.

14. The fusing device of claim 9, further comprising another lead formed on another end of the heater of the fusing roller, another power supply unit having another electrode to be coupled to another lead of the heater, another end cap having another first portion connected to another electrode of another power supply unit, another second portion fixedly coupled to another end of the cylindrical roller, and another hole formed on another second portion of the another end cap to communicate with the another first portion of another end cap and to allow the lead and another lead of the heater to be coupled to the electrode and another electrode disposed in the respective ones of the first portion of the end cap and another first portion of the another end cap.

15. The fusing device of claim 14, further comprising a pair of frames rotatably supporting the power supply unit and another power supply unit.

16. The fusing device of claim 14, wherein another end cap comprises:

a gear formed on an outer circumference of the another end cap and coupled to a rotation power source to rotate the fusing roller.

17. The fusing device of claim 9, further comprising:

a locking unit connecting the second portion of the end cap to the end of the cylindrical roller.

18. The fusing device of claim 17, wherein the locking unit comprises:

a plurality of convex portions formed on an outer surface of the second portion of the end cap to be spaced apart from each other; and a plurality of concave portions disposed to be spaced-apart from each other and formed on an inner surface of the cylindrical surface to correspond to the convex portions.

19. The fusing device of claim 18, wherein the locking unit comprises:

a plurality of tapered protrusions formed on the outer surface of the second portion and disposed between adjacent convex portions to be spaced-apart from each other; and a plurality of recesses formed on the inner surface of the cylindrical roller and disposed between adjacent concave portions to be spaced-apart from each other and to correspond to the tapered protrusions.

20. A fusing device of an electrophotographic image forming apparatus comprising:

a fusing roller comprising:

a tubular internal pipe sealed to maintain a predetermined internal pressure and having an inner space to accommodate a predetermined amount of a working fluid, a heater formed around the internal pipe to generate heat and having a plurality of leads formed on both ends of the heater, and a cylindrical roller formed on the heater;

a plurality of power supply units each having an electrode to supply an external power to the heater;

a plurality of end caps each having a first portion connected to the electrode, a second portion fixedly coupled to an end of the cylindrical roller, and a hole formed on the second portion to communicate with the first portion of the end cap and to allow the electrode and the lead to be connected to each other;

a gear formed on one of the end caps and coupled to a rotation power source to rotate the fusing roller; and a locking unit connecting the second portion of the end cap to the end of the cylindrical roller.

* * * * *